US010329720B2

(12) United States Patent
Nelson et al.

(10) Patent No.: US 10,329,720 B2
(45) Date of Patent: Jun. 25, 2019

(54) PRE-ENGINEERED FLAT-PACK BRIDGE

(71) Applicant: CAPITAL PROJECT MANAGEMENT PTY LTD, Perth (AU)

(72) Inventors: Brian Athol Nelson, South Perth (AU); Kenneth John Knuckey, South Perth (AU)

(73) Assignee: CAPITAL PROJECT MANAGEMENT PTY LTD, Perth (AU)

( * ) Notice: Subject to any disclaimer, the term of this patent is extended or adjusted under 35 U.S.C. 154(b) by 0 days.

(21) Appl. No.: 15/755,981

(22) PCT Filed: Sep. 1, 2016

(86) PCT No.: PCT/AU2016/000305

§ 371 (c)(1),
(2) Date: Feb. 27, 2018

(87) PCT Pub. No.: WO2017/035564

PCT Pub. Date: Mar. 9, 2017

(65) Prior Publication Data

US 2018/0238001 A1 Aug. 23, 2018

(30) Foreign Application Priority Data

Sep. 1, 2015 (AU) ..... 2015903571

(51) Int. Cl.

| | |
|---|---|
| ***E01D 2/00*** | (2006.01) |
| ***E01D 21/00*** | (2006.01) |
| ***E01D 19/10*** | (2006.01) |

(52) U.S. Cl.
CPC ..... *E01D 2/00* (2013.01); *E01D 19/103* (2013.01); *E01D 21/00* (2013.01)

(58) Field of Classification Search
CPC ..... E01D 19/52; E01D 19/103; E01D 15/12; E01D 21/00
USPC ..... 14/3–13, 73, 74.5, 77.1, 2.4
See application file for complete search history.

(56) References Cited

U.S. PATENT DOCUMENTS

| | | | | |
|---|---|---|---|---|
| 1,462,541 | A * | 7/1923 | Gallagher | E01D 15/133 14/2.4 |
| 5,437,072 | A * | 8/1995 | Dinis | E01D 2/04 104/124 |
| 5,471,694 | A * | 12/1995 | Meheen | E01D 2/04 14/73 |
| 5,920,936 | A * | 7/1999 | Wiedeck | E01D 15/124 14/13 |
| 6,345,403 | B1 * | 2/2002 | Nagle | E01D 2/02 14/77.1 |
| 6,557,201 | B1 * | 5/2003 | Bowman | B29C 70/443 14/2.4 |

(Continued)

*Primary Examiner* — Raymond W Addie
(74) *Attorney, Agent, or Firm* — Woodling, Krost and Rust

(57) ABSTRACT

A variably dimensionable bridge (10) comprising pre-engineered components provided in a kit. The pre-engineered components are constructed of fiber reinforced polymer (FRP) composite material and include at least one floor module (14) for providing a floor; at least two girders (12) for providing opposing substantial vertical sides; and at least two cross beams (16) to lend support to the girders (12). A is a method for constructing a bridge (10) of variable dimensions comprising the use of pre-engineered components provided in a flat-pack kit.

9 Claims, 6 Drawing Sheets

(56) References Cited

U.S. PATENT DOCUMENTS

| | | | | |
|---|---|---|---|---|
| D579,575 | S * | 10/2008 | Lockwood | D25/113 |
| 7,810,285 | B1 * | 10/2010 | Liptak | E04F 11/1851 256/24 |
| 9,422,716 | B2 * | 8/2016 | Chandra | E04C 3/28 |
| 9,551,119 | B2 * | 1/2017 | Tirimanna | E01D 15/133 |
| 2009/0007348 | A1 * | 1/2009 | Woodmansee, III | E01D 15/124 14/2.4 |
| 2017/0191232 | A1 * | 7/2017 | Wise | E01D 15/133 |

* cited by examiner

PRE-ENGINEERED FLAT-PACK BRIDGE

PCT/AU2016/000305, international application filing date 1 Sep. 2016, and Australian provisional patent application no. 2015903571 filed 1 Sep. 2015 are incorporated herein by reference hereto in their entireties.

FIELD OF THE INVENTION

The present invention relates to a pre-engineered flat-pack bridge.

BACKGROUND

On a world-wide scale there is increasing demand for small bridges, especially for pedestrian and bicycle use. The demand is from both developed, and undeveloped nations. Typically a unique solution is required for each location to address requirements including size, material and terrain at the bridge site, for example.

Currently, bridges are designed, engineered and constructed to meet site-specific demands including size, traffic characteristics, material and terrain, for example, at each location where a bridge is required. Using current approaches to design, engineering and construction, a bridge designed for one location tends to be unique and is rarely suited to another location. Consequently, the time and costs associated with design, engineering and construction of small bridge solutions are excessive.

The present invention attempts to overcome at least in part the aforementioned disadvantages of the current approach by providing a cost effective, pre-engineered holistic solution to the design, manufacture and construction of small bridges, in particular bridges for pedestrian and bicycle use.

SUMMARY OF THE INVENTION

In accordance with one aspect of the present invention there is provided a variably dimensionable bridge comprising pre-engineered components provided in a kit.

The kit may be provided as a flat-pack.

The pre-engineered components may be constructed of fibre reinforced polymer composite material.

The pre-engineered components may comprise: at least one floor module for providing a floor; at least two girders for providing opposing substantial vertical sides; and at least two cross beams to lend support to the girders.

The bridge according to claim 4, wherein at least one cross beam is proximal to each end of the bridge.

The bridge may further comprise at least one reinforcement member receivable within channels within the girders.

The reinforcement member may be constructed of dowel materials. The reinforcement member may comprise continuous selected grout filling.

The bridge may be lengthened by providing a plurality of floor modules, pairs of girders, and cross beams, joined in sequence. The width of the bridge may be varied by providing alternative width floor modules and cross beams.

The girder may comprise a lengthened upright side portion for providing a balustrade to the bridge. The balustrade may be provided as a separate component to the girder.

The upright side portion may be filled for providing a solid balustrade. The upright side portion may be at least partially open for providing a balustrade containing spaces.

In accordance with a second aspect of the present invention there is provided a method for constructing a bridge of variable dimensions comprising the use of pre-engineered components provided in a kit.

The pre-engineered components of the method may comprise: at least one floor module for providing a floor; at least two girders for providing opposing substantial vertical sides; and at least two cross beams to lend support to the girders.

BRIEF DESCRIPTION OF DRAWINGS

The present invention will now be described, by way of example, with reference to the accompanying drawings, in which.

DESCRIPTION OF PREFERRED EMBODIMENTS

Figure 1:
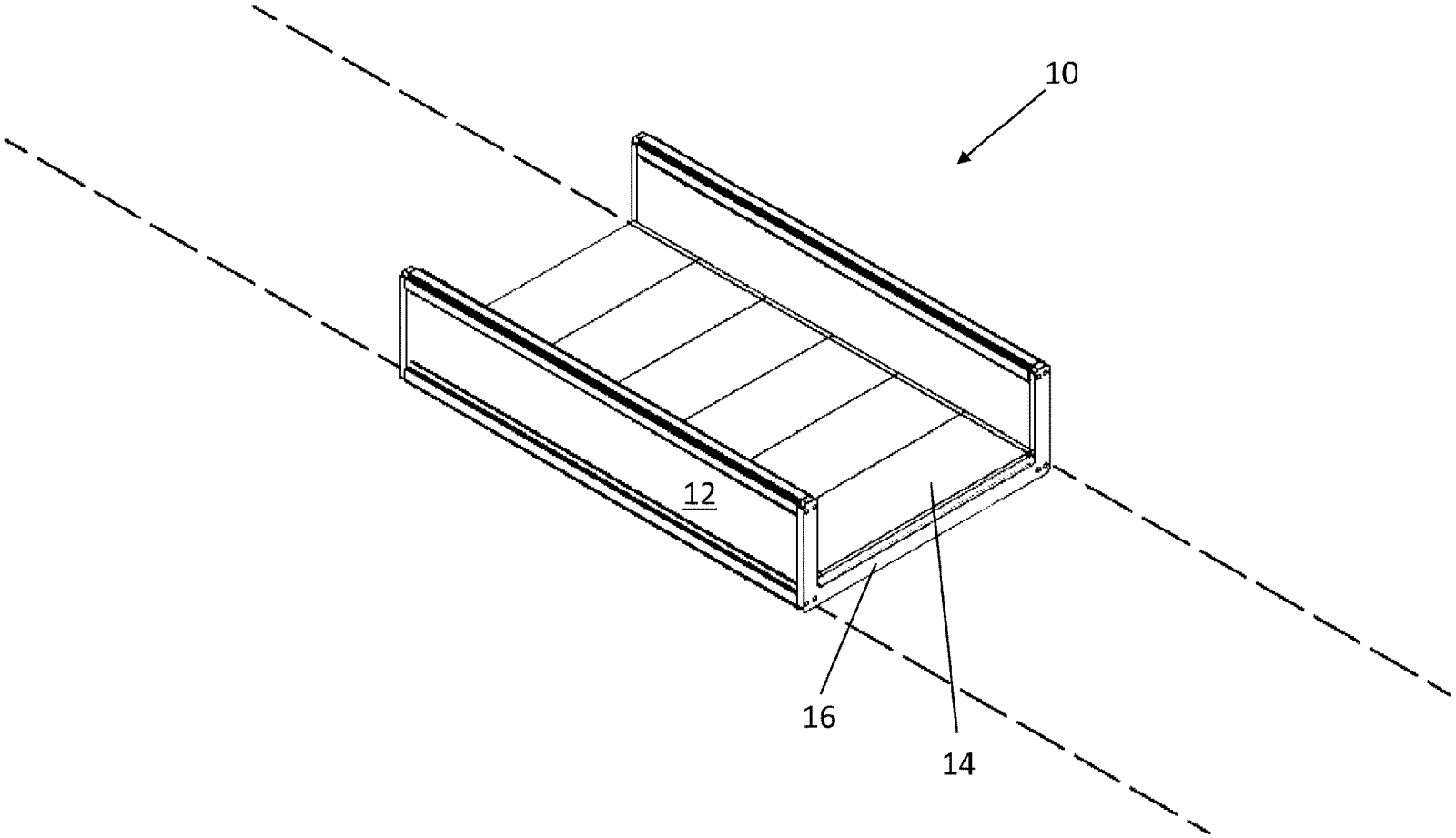
FIG. 1 is an upper perspective view of a flat-pack bridge 10 according to the present invention.

Referring to FIG. 1, there is shown a flat-pack bridge 10, in its assembled arrangement, for providing a span of a distance. The bridge 10 comprises: at least one floor module 14 for providing a floor; at least two girders 12 for providing opposing substantially vertical sides; and at least two cross beams 16 to lend support to the girders 12. It is preferred that these primary components of the bridge 10 are constructed of fibre reinforced polymer (FRP) composite incorporating carbon and glass fibre. This allows the bridge 10 to be very lightweight while still possessing structural compliance with international design standards.

Figure 2:
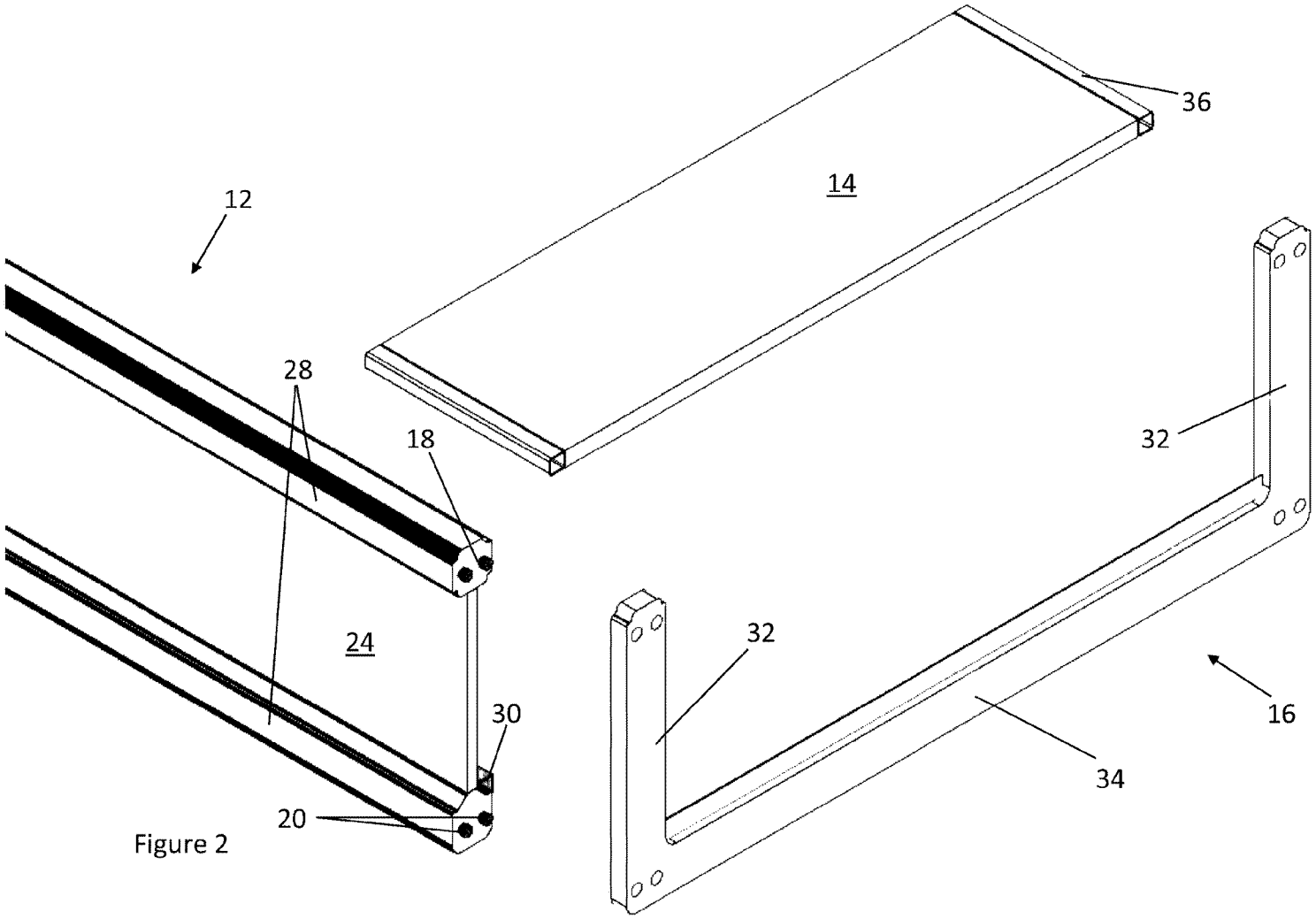
FIG. 2 is an upper perspective exploded view of components of the flat-pack bridge 10 of FIG. 1.

With reference to FIG. 2, each girder 12 is elongated in shape, having at least one upper and one lower chord 28. The chords 28 preferably comprise a wider profile than that of the remaining girder 12. In accordance with a first embodiment of the present invention, the girder 12 may comprise a lengthened upright side portion 24 providing a balustrade to the bridge 10.

Figure 4:
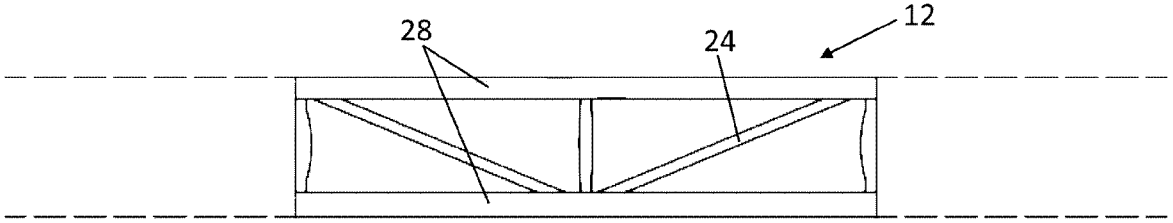
FIG. 4 is a side plan view of a girder 12 with an open balustrade 24.
Figure 6:
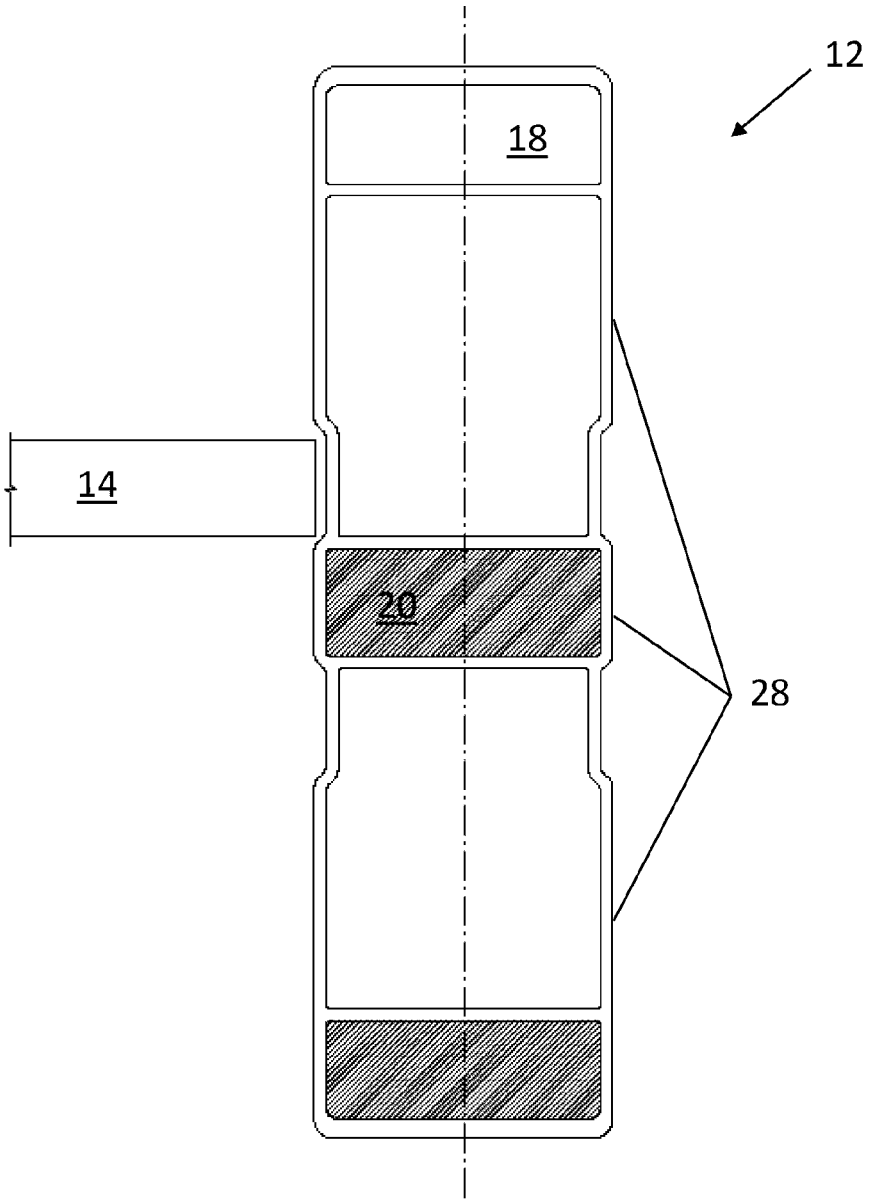
FIG. 6 is an end plan view of a girder 12 of the flat-pack bridge 10 in accordance with a second embodiment of the present invention.
Figure 7:
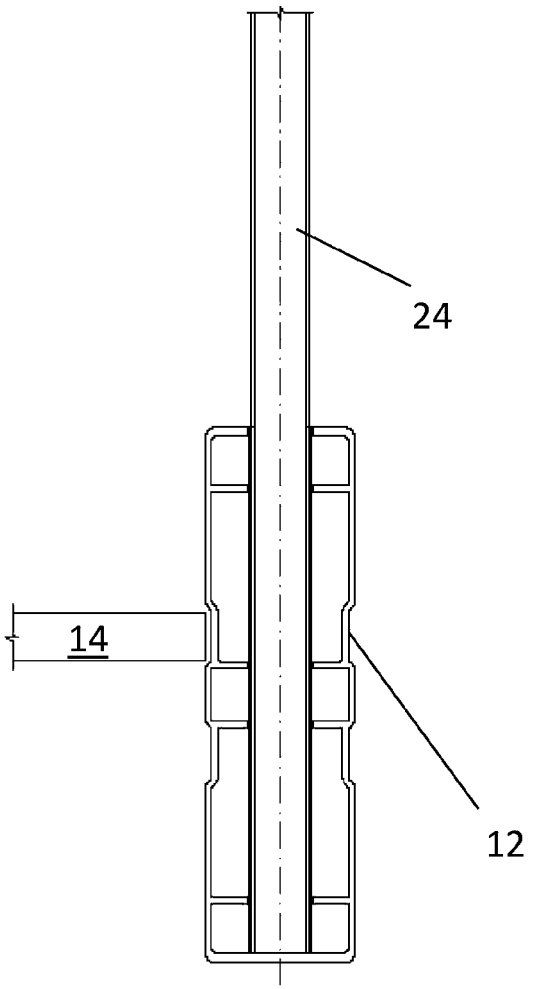
FIG. 7 is an end plan view of the girder 12 of FIG. 6 provided with a separate balustrade 24.

Alternatively, in accordance with a second embodiment, the girder 12 may be provided without lengthened upright side portions 24, as shown in FIG. 6. Further still, the bridge 10 may be provided with balustrade 24, but as a separate component, rather than integrally formed with the girder 12, as shown in FIG. 7. With reference to FIG. 4, any embodiment of the bridge 10 may be optionally provided with a railed or otherwise open balustrade 24, or with the solid or filled balustrade 24 as shown in FIG. 2.

Each girder 12 further comprises at least one channel 18 arranged so that a reinforcement member 20 is receivable within its length. The reinforcement members 20 may be constructed of dowel materials. The channel 18 may be disposed in the upper and/or lower chords 28 of the girder 12, or through a central chord 28, and run the entire length of the girder 12. It is preferred that each girder 12 comprises at least two channels 18. Accordingly a pair of reinforcement members 20 are disposed within the chords 28 of the girder 12.

It is preferred that the lower or central chord 28 of the girder 12 is shaped such that a substantially square edge 30 is provided on the inner side of the girder 12. The edge 30 provides a suitable point of attachment for a floor module 14.

According to a first embodiment of the present invention, the cross beam 16 is a somewhat square U-shaped frame component with opposed uprights 32 joined to a horizontal span 34. The uprights 32 comprise at least one aperture 22 disposed so that when the cross beam 16 is aligned with the girders 12, the channels 18 in the girders 12 are aligned with the apertures 22 in the cross beam 16. Accordingly, a reinforcement member 20 may pass into and/or through an aligned aperture 22. The horizontal span 34 is of complementary length to the width of the floor module 14 and hence the bridge 10. In accordance with a second embodiment, the cross beam 16 is merely the horizontal span 34 of the frame component, with no opposed uprights.

Both the girder 12 and cross beam 16 are each preferably manufactured as a single moulded piece. Accordingly, high quality finishes not generally available to bridge structures can be achieved with this invention.

Figure 3:
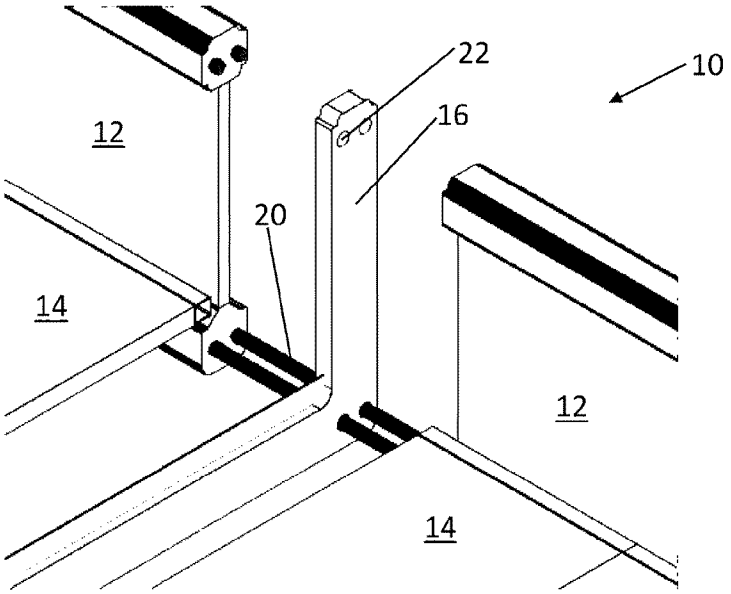
FIG. 3 is an upper perspective exploded view of detail of the flat-pack bridge 10 of FIG. 1.

It is preferred that the floor module 14 is substantially flat and quadrilateral in shape. As above, the width of the floor module 14 defines the width of the bridge 10. It is preferred that the length of the floor module 14 is a fraction of the length of the girders 12 such that numerous aligned floor modules 14 form the floor of the bridge 10. The floor module 14 optionally comprises end rails 36 disposed at opposite ends of the floor module 14. The end rails 36, if present, are shaped and arranged such that they complement the square edge 30 of the girders 12. Accordingly, the end rails 36 of the floor module 14, or merely each side of the floor module 14, fit with the square edge 30 of the girder 12 for secure connection thereto, as best seen in FIG. 3. It has been advantageously found that connection of the floor module 14 in this manner provides lateral stability to the bridge 10, and the need for secondary bracing is eliminated.

With further reference to FIG. 3, the length of the bridge 10 may be varied by increasing the number of each of the components of the bridge 10 and interconnecting them longitudinally as represented by the broken lines in FIGS. 1 and 4. Hence, another pair of girders 12 with one or more floor modules 14 disposed between them may be aligned with an end of the bridge 10. In this case, the pair of reinforcement members 20 span the join between multiple girders 12, passing through the apertures 22 provided within the cross beam 16 connecting the two pairs of girders 12.

In the case of this lengthened bridge 10 comprising at least two pairs of girders 12, it is preferred that longer reinforcement members 20 are provided within the length of the channels 18 of the bridge 10. Accordingly, continuous reinforcement members 20 lend increased strength to the lengthened bridge 10.

Figure 5:
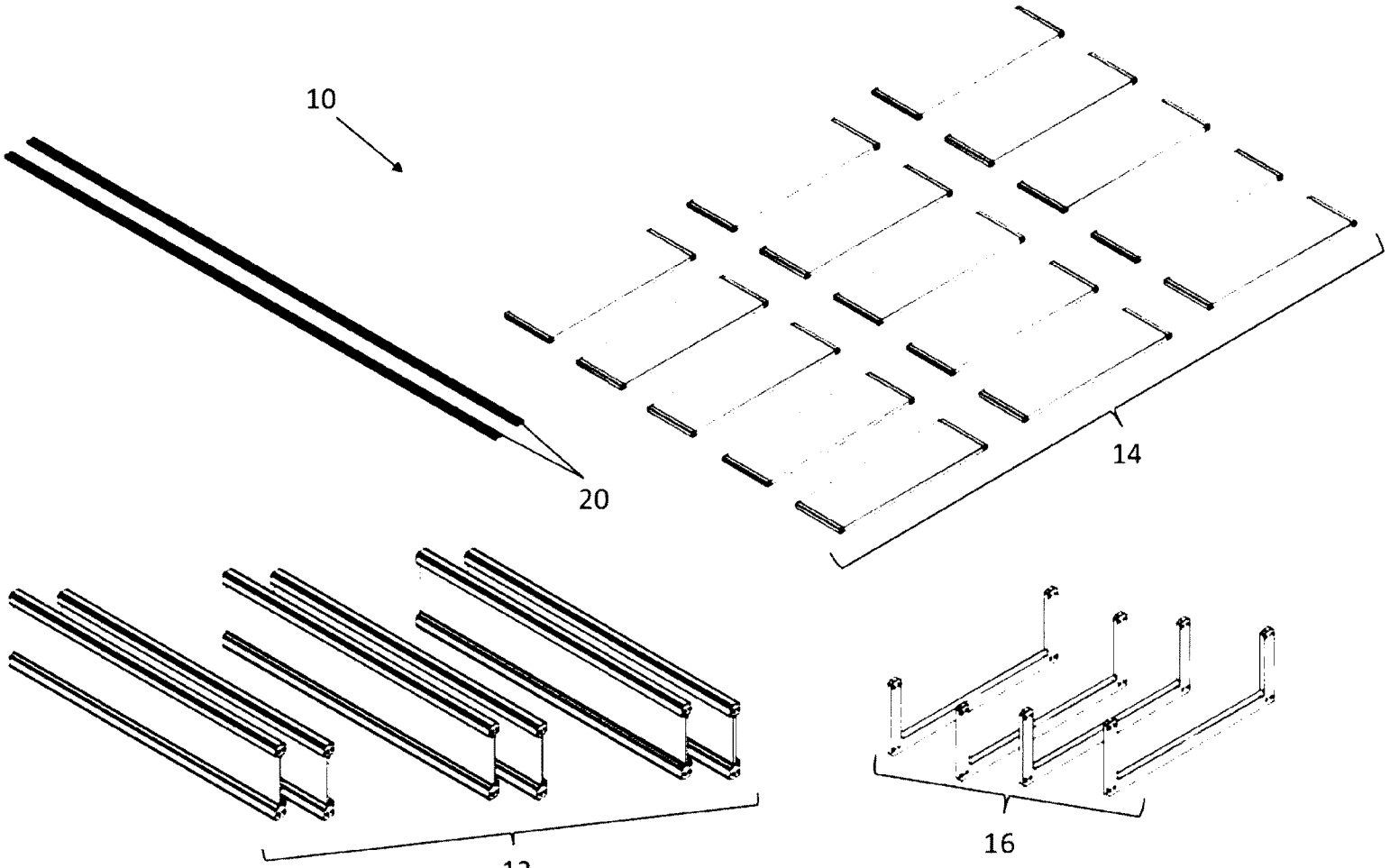
FIG. 5 is an upper perspective view of the flat-pack bridge 10 of FIG. 1 in a disassembled arrangement.

With reference to FIG. 5, the bridge 10 is shown in its disassembled arrangement. Accordingly, the pairs of girders 12, floor modules 14, cross beams 16 and reinforcement members 20 may be stored, transported and delivered to site as a flat-pack, thereby resulting in a saving of space, time and costs. Additionally, the components are factory finished, including colour-infused, according to the preference of the bridge 10 customer, prior to packing.

As described above, variable length bridges 10 may be provided in accordance with the present invention. Similarly, variable width bridges 10 may also be provided, to meet the needs of users, or the span across which the bridge 10 is to be constructed, for example. As such, the width of each floor module 14 may be provided to correspond with the desired width of the bridge 10. As would be understood, the horizontal span 34 of the cross beam 16 would be adjusted accordingly.

In use, the bridge 10 components are provided in a flat-pack arrangement for storage and transportation, for example, in preparation for construction of the bridge 10. The number and size of packed bridge 10 components varies according to the desired length and width of the bridge 10. At an appropriate time, usually once the flat-pack bridge 10 components have been transported to a suitable location for assembly, the components are unpacked and assembled to form the bridge 10.

The primary elements of the bridge 10 are assembled as would be understood by a person skilled in the art. During assembly, at least one reinforcement member 20 is inserted into the channel 18 within a single girder 12 or multiple girders 12 in longitudinal alignment. Optionally, resin is injected into the one or more channels 18, after insertion of its respective reinforcement member 20, and allowed to cure, to further reinforce the bridge 10.

Once fully assembled and cured, the bridge 10 is lifted to its preferred location to enable spanning of a distance therewith. Preferably, the bridge 10, once in its final location, is securely attached to previously provided foundations.

The conveniently provided components of the bridge 10 within a kit, which are lightweight and manageable, make the invention suitable for rapid assembly. In addition, only a small crane, if any, is required to complete installation of the bridge 10. This results in not only a cost saving, but the environmental impact during construction is low.

Other embodiment flat-pack bridges 10 are also contemplated in accordance with the present invention. For instance, the aforementioned floor module 14 may, instead of being provided as substantially flat and quadrilateral in shape, be any shape and profile suited to the relevant function of providing a bridge floor. Likewise, the square edge 30 of the girder 12 and end rails 36 of floor modules 14 may be provided as any suitable means for complementarily securing a floor module 14 to a girder 12.

Further, a reinforcement member 20 may be provided as continuous selected grout filling to a channel 18 within a girder 12, rather than comprising dowel materials. In such a case, when constructing the bridge 10, the reinforcement member is provided by filling the channel 18 with the grout filling. The cross beams 16 may also be reinforced with continuous selected grout filling optionally in combination with rods.

Modifications and variations as would be apparent to a skilled addressee are deemed to be within the scope of the present invention.

The invention claimed is:

1. A pre-engineered bridge, comprising:

a floor, a plurality of girders disposed laterally of the floor, a plurality of newel frames disposed at spaced intervals along the floor, wherein each girder comprises upper and lower longitudinally extending chords, each chord being provided with a longitudinally extending internal channel, the newel frames each comprising spaced lateral upright members and a generally horizontal base member interconnecting the upright members, the components of the newel frames comprising a plurality of apertures, elongated reinforcement members extending end to end through respective internal channels of the chords and engaging with respective apertures in the newel frames, the floor being comprised of a plurality of contiguous panel members which extend between the girders and are laterally supported on respective lower chords of the girders.

2. A bridge according to claim 1, characterized in that at least one newel frame is located adjacent to each end of each girder.

3. A bridge according to claim 1, wherein the reinforcement members are formed of dowel materials.

4. A bridge according to claim 1 wherein the reinforcement members are formed of resin or grout filling material.

5. A bridge according to claim 1, wherein the components thereof are formed of fibre reinforced polymer composite material.

6. A bridge according to claim 1 wherein the components of the bridge are in the form of a flat pack construction.

7. A bridge according to claim 1, wherein at least one girder comprises an upright side portion for providing a balustrade for the bridge.

8. A bridge according to claim 7, wherein the upright side portion is filled so as to provide a solid balustrade.

9. A bridge according to claim 7, wherein the upright side portion is at least partially open to provide balustrade containing spaces.

* * * * *